US010080977B2

(12) United States Patent
Rosen et al.

(10) Patent No.: US 10,080,977 B2
(45) Date of Patent: Sep. 25, 2018

(54) MAGNETIC MODULE AND CONSTRUCTION KIT

(71) Applicant: LaRose Industries, LLC, Randolph, NJ (US)

(72) Inventors: Lawrence Rosen, Mendham, NJ (US); Parviz Daftari, Summit, NJ (US)

(73) Assignee: LAROSE INDUSTRIES, LLC, Randolph, NJ (US)

( * ) Notice: Subject to any disclaimer, the term of this patent is extended or adjusted under 35 U.S.C. 154(b) by 33 days.

(21) Appl. No.: 15/427,972

(22) Filed: Feb. 8, 2017

(65) Prior Publication Data

US 2017/0232357 A1 Aug. 17, 2017

Related U.S. Application Data

(60) Provisional application No. 62/293,938, filed on Feb. 11, 2016.

(51) Int. Cl.

| | |
|---|---|
| ***A63H 33/04*** | (2006.01) |
| ***A63H 33/08*** | (2006.01) |
| ***A63H 33/10*** | (2006.01) |

(52) U.S. Cl.

CPC ..... *A63H 33/046* (2013.01); *A63H 33/04* (2013.01); *A63H 33/08* (2013.01); *A63H 33/101* (2013.01)

(58) Field of Classification Search

CPC .... A63H 33/04; A63H 33/044; A63H 33/046; A63H 33/06; A63H 33/062; A63H 33/08; A63H 33/086; A63H 33/088

See application file for complete search history.

(56) References Cited

U.S. PATENT DOCUMENTS

| | | | | |
|---|---|---|---|---|
| 3,195,266 | A * | 7/1965 | Onanian | A63H 33/101 174/138 D |
| 3,564,758 | A * | 2/1971 | Willis | A63H 33/06 428/542.2 |
| 3,604,145 | A * | 9/1971 | Zimmerman | A63H 33/065 24/16 PB |

(Continued)

FOREIGN PATENT DOCUMENTS

| | | |
|---|---|---|
| EP | 2590183 | 5/2013 |
| JP | 2002-159761 | 6/2002 |

(Continued)

OTHER PUBLICATIONS

Smartmax General Instructions, Smart—Belgium, Brochure (2003-2015).

*Primary Examiner* — Gene Kim
*Assistant Examiner* — Alyssa Hylinski
(74) *Attorney, Agent, or Firm* — Greenberg Traurig, LLP

(57) ABSTRACT

The present disclosure relates to a magnetic module assembly having opposing geometric frames and a plurality of connector struts that connect and extend between the geometric frames. Each of the geometric frames has a plurality of segments, with each segment having a magnet enclosure integrated in the segment. The segments are interposed between attachment points formed in the geometric frame, each attachment point having a pair of receptacles that are sized and shaped to receive a corresponding pair of connector pins from a connector strut. The segments of a geometric frame have a larger thickness compared to that of the attachment points, making the attachment points of the frame frangible.

11 Claims, 9 Drawing Sheets

(56) References Cited

U.S. PATENT DOCUMENTS

| | | | | |
|---|---|---|---|---|
| 3,991,511 | A * | 11/1976 | McAllister | A63H 33/06 428/192 |
| 5,575,701 | A * | 11/1996 | Hantman | A63H 33/10 446/104 |
| 5,683,283 | A | 11/1997 | Glynn | |
| 5,788,555 | A | 8/1998 | Glynn | |
| 5,823,531 | A | 10/1998 | Huber | |
| 5,938,498 | A | 8/1999 | Glynn | |
| 7,154,363 | B2 * | 12/2006 | Hunts | H01F 7/0242 335/306 |
| 7,758,398 | B2 | 7/2010 | Park | |
| 8,016,636 | B2 | 9/2011 | Park | |
| 8,458,863 | B2 * | 6/2013 | Hunts | H01F 7/0242 24/303 |
| 8,911,276 | B2 * | 12/2014 | Kim | A63H 33/046 446/92 |
| 9,022,829 | B2 * | 5/2015 | Rosen | A63H 33/046 446/108 |
| 9,669,324 | B2 * | 6/2017 | Roth | A63H 33/062 |
| 2012/0131878 | A1 * | 5/2012 | Ivanov | A63H 33/084 52/655.1 |
| 2013/0111710 | A1 | 5/2013 | Hunts | |
| 2016/0074766 | A1 * | 3/2016 | Choi | A63H 33/046 446/92 |

FOREIGN PATENT DOCUMENTS

| | | |
|---|---|---|
| JP | 2003-190663 | 7/2003 |
| WO | 2006044613 | 4/2006 |

* cited by examiner

MAGNETIC MODULE AND CONSTRUCTION KIT

CROSS-REFERENCE TO RELATED APPLICATION

The present application claims the benefit of U.S. Provisional Patent Application No. 62/293,938, filed on Feb. 11, 2016, which is incorporated by reference herein in its entirety.

FIELD OF THE INVENTION

The following disclosure relates to magnetic modules, and more particularly, to magnetic modules that may be used with other like modules in a toy construction kit for building structures.

BACKGROUND OF THE INVENTION

Magnetic construction kits have become a popular category for children's toys. These kits ordinarily include construction modules having magnets embedded therein that enable the modules to be connected together via magnetism. Using these modules, children are able to assemble many imaginative two-dimensional and three-dimensional shapes and structures, thereby imparting great enjoyment and entertainment to the children using them.

SUMMARY OF THE INVENTION

In view of the foregoing background, a magnetic modular block assembly is disclosed. The assembly includes opposing first and second geometric frames and a plurality of connector pieces or struts that interconnect the first and second geometric frames. Each of the geometric frames has a plurality of segments or legs interposed between a corresponding number of corners formed in the geometric frame, with each corner being sized and shaped to (1) interface with one of the plurality of connector pieces or struts, thereby allowing the connector pieces or struts to interconnect the geometric frames; and (2) be frangible such that whenever the frame experiences significant stress through twisting or blunt force, one or more of the corners will break to relieve such stress before the segments or legs do.

BRIEF DESCRIPTION OF THE DRAWINGS

For a more complete understanding of the present invention, reference is made to the following detailed description of various exemplary embodiments considered in conjunction with the accompanying drawings, in which.

DETAILED DESCRIPTION OF THE INVENTION

The following disclosure is presented to provide an illustration of the general principles of the present invention and is not meant to limit, in any way, the inventive concepts contained herein. Moreover, the particular features described in this section can be used in combination with the other described features in each of the multitude of possible permutations and combinations contained herein.

All terms defined herein should be afforded their broadest possible interpretation, including any implied meanings as dictated by a reading of the specification as well as any words that a person having skill in the art and/or a dictionary, treatise, or similar authority would assign thereto.

Further, it should be noted that, as recited herein, the singular forms "a", "an", and "the" include the plural referents unless otherwise stated. Additionally, the terms "comprises" and "comprising" when used herein specify that certain features are present in that embodiment. However, this phrase should not be interpreted to preclude the presence of additional steps, operations, features, components, and/or groups thereof.

Figure 1:
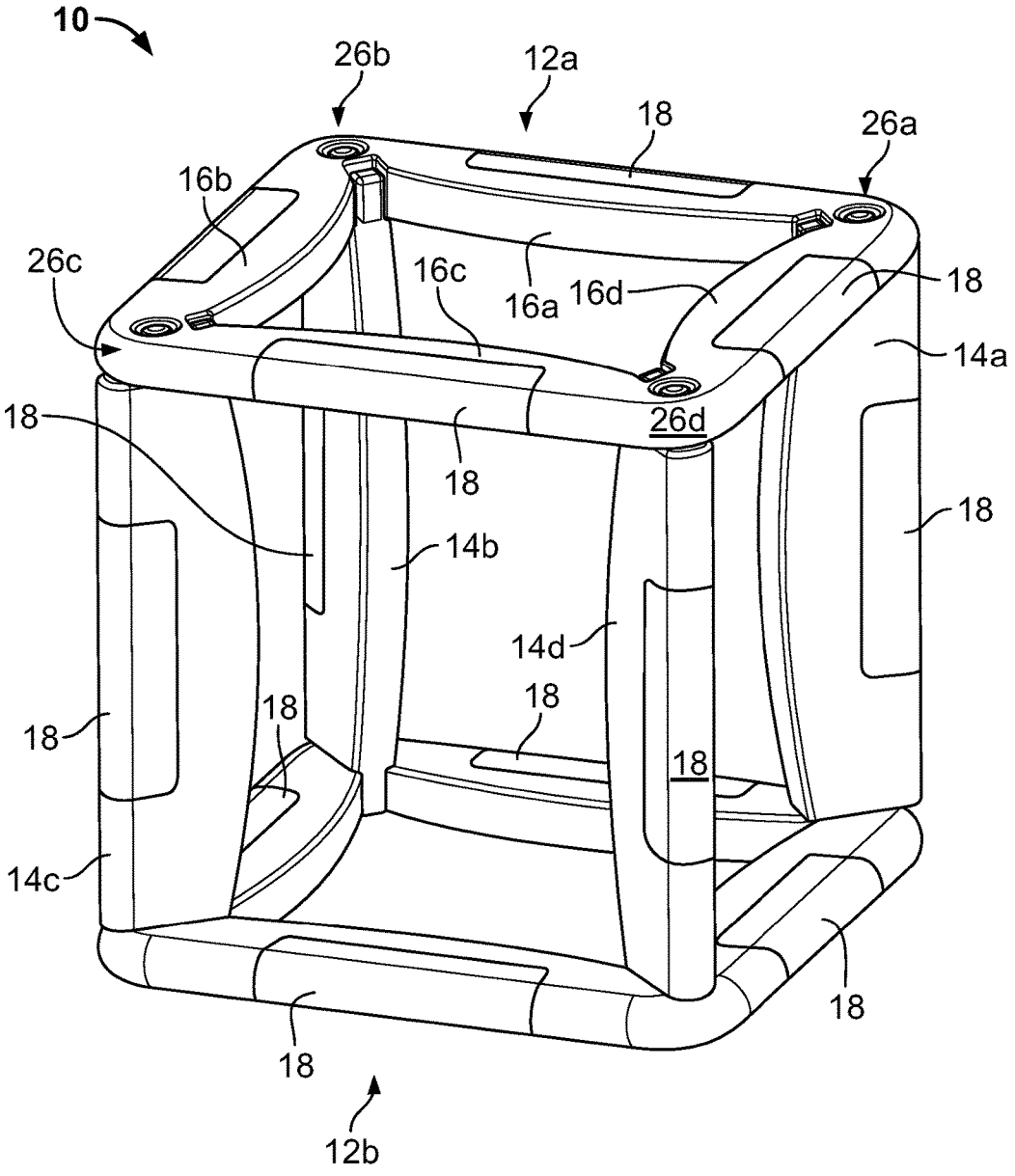
FIG. 1 is a perspective view of a three-dimensional magnetic module assembly constructed in accordance with an embodiment of the present invention, the assembly having two opposing square-shaped frames and four connector struts which interconnect with the square-shaped pieces.
Figure 2:
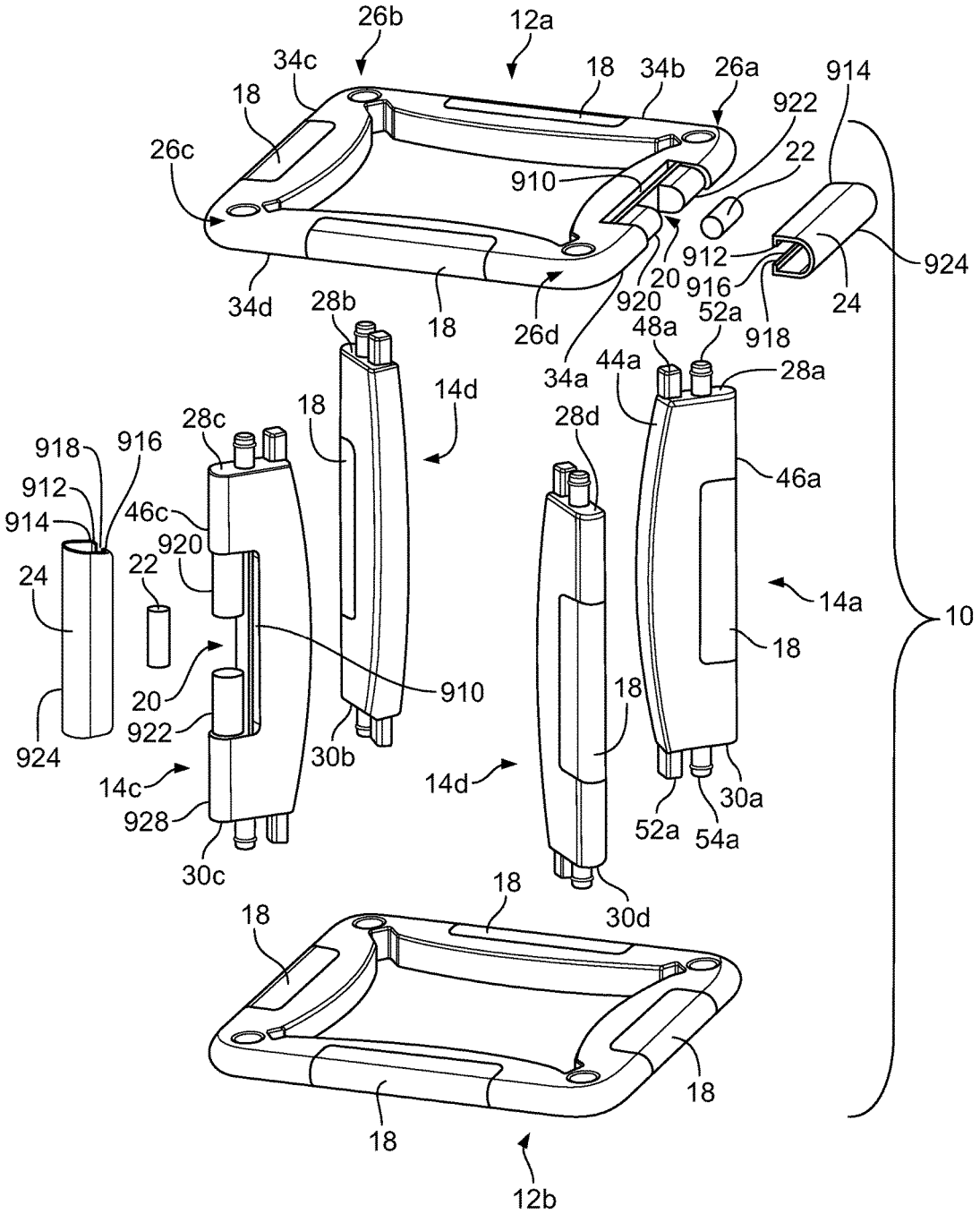
FIG. 2 is an exploded view of the assembly shown in FIG. 1.

Turning now to the figures, FIGS. 1 and 2 illustrate a three-dimensional cubic block assembly 10 constructed in accordance with an embodiment of the present invention. The assembly 10 is made from two square-shaped frames 12*a*, 12*b* and four connector pieces or struts 14*a*, 14*b*, 14*c*, 14*d* that interconnect and extend between the frames 12*a*, 12*b*. Each of the square-shaped frames 12*a*, 12*b* has four side segments or legs 16*a*, 16*b*, 16*c*, 16*d*, each of which includes a magnet enclosure 18, as does each of the connector struts 14*a*, 14*b*, 14*c*, and 14*d*. Each magnet enclosure 18 is positioned to be facing toward the outside of the assembly 10 and defines a point of contact for the assembly 10 to magnetically connect with other magnetic modules.

Turning to FIG. 2, an exemplary magnet enclosure 18 comprises a cavity 20 at an outer edge 46*a* of the frame 12*a* inside which a bar magnet 22 (see FIG. 2) is located, and a cap 24 to secure the magnet 22 within the cavity 20. The cavity 22 is sized and shaped to receive the magnet 22 such that the longitudinal axis of the magnet 22 is substantially parallel to the outer edge 46*a* at the location of the cavity 20. The cap 24 covers magnet 22 and the cavity 20 so as to prevent the magnet 22 from escaping the cavity 20 in instances where the magnet enclosure 18 experiences significant shear or rotational stress (e.g., when shearing or rotational stress to the frame 12*a*). In one embodiment, the cap 22 is secured to the cavity 20 using ultrasonic welding. An exemplary connector strut 14*c* also has a magnet enclosure 18 having a cavity 20, a bar magnet 22, and a cap 24 in essentially the same arrangement as is shown and discussed with respect to frame 12*a*, except that the magnet enclosure 18 of the connector strut 14*c* is at an edge 46*c* of the connector strut 14*c*, rather than at edge 34*a* of frame 12*a*.

Continuing to refer to FIG. 2, an exemplary embodiment of the frame 12*a* has a groove 910 in the frame 12*a* located adjacent the cavity 20 and substantially parallel to the edge 46*a*. A similarly arranged groove (not shown) is present on the opposite side (not shown) of the frame 12*a*. The cap 24 has a C-shaped cross-section and teeth 912, 914 proximate opposite ends 916, 918 of the cap 24. The cap 24, teeth 912, 914, and groove 910 are arranged such that the cap 24 attaches to the frame 12*a* with the tooth 912 fit into the groove 910 and the tooth 914 fit into the groove on the opposite side of the frame 12*a* in a snap fit. In the exemplary embodiment of the frame 12*a*, nubs 920, 922 extend from the cavity 20 and are sized and shaped such that the cap 24 covers the nubs 920, 922, the cavity 20, and the magnet 22 with the outer surface 924 of the cap 24 flush with the outer surface 926 of the frame 12*a*. The exemplary connector strut 14*c* has an arrangement of its respective groove 910, teeth 912, 914, nubs 920, 922, and cap 24 that is essentially the same as shown and discussed with respect to frame 12*a*, except that the magnet enclosure 18 of the connector strut 14*c* is at an edge 46*c* of the connector strut 14*c*, rather than at edge 34*a* of frame 12*a*, and the outer surface of connector strut 14*c* is outer surface 928.

Continuing to refer to FIG. 2, each frame in the assembly 10 (i.e., frames 12*a* and 12*b*) has a plurality of attachment points (i.e., corners 26*a*, 26*b*, 26*c*, and 26*d*) located at the intersections of the side segments 16*a*-16*d*. Each connector strut in the assembly 10 (i.e., connector struts 14*a*-14*d*) has a first attachment end located at one end of the connector strut (see first attachment ends 28*a*, 28*b*, 28*c*, and 28*d*) and a second attachment end located at an opposite end of the connector strut (see second attachment ends 30*a*, 30*b*, 30*c*, and 30*d*). The first attachment ends 28*a*-28*d* and the second attachment ends 30*a*-30*d* of the connector struts 14*a*-14*d* are sized and shaped to interface with the attachment points 26*a*-26*d* located on each of the frames 12*a*, 12*b*. The attachment points of the frames and the attachment ends of the connector struts will be discussed in greater detail below.

Figure 3:
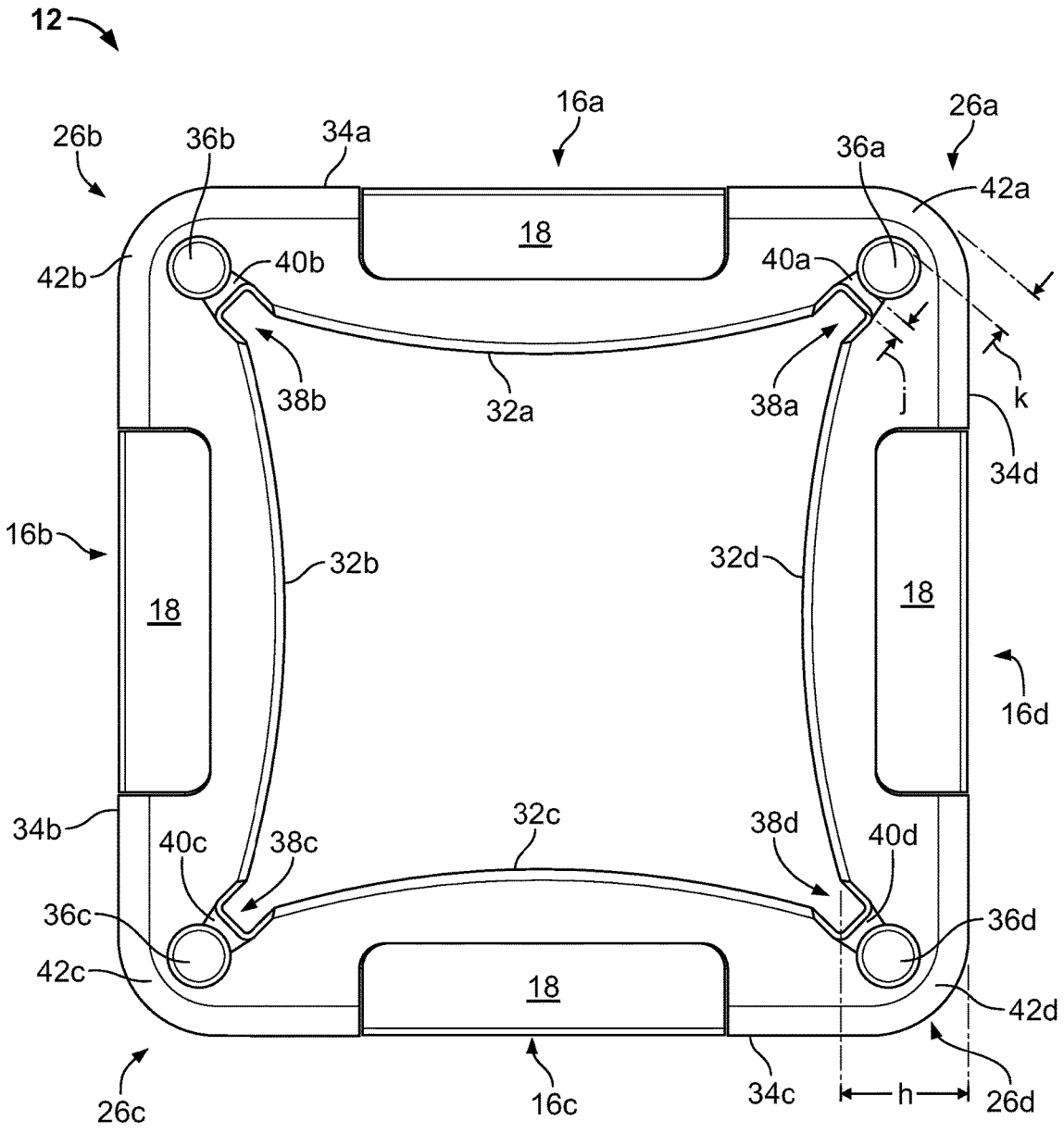
FIG. 3 is a top plan view of one of the square-shaped frames depicted in FIGS. 1 and 2.
Figure 4:
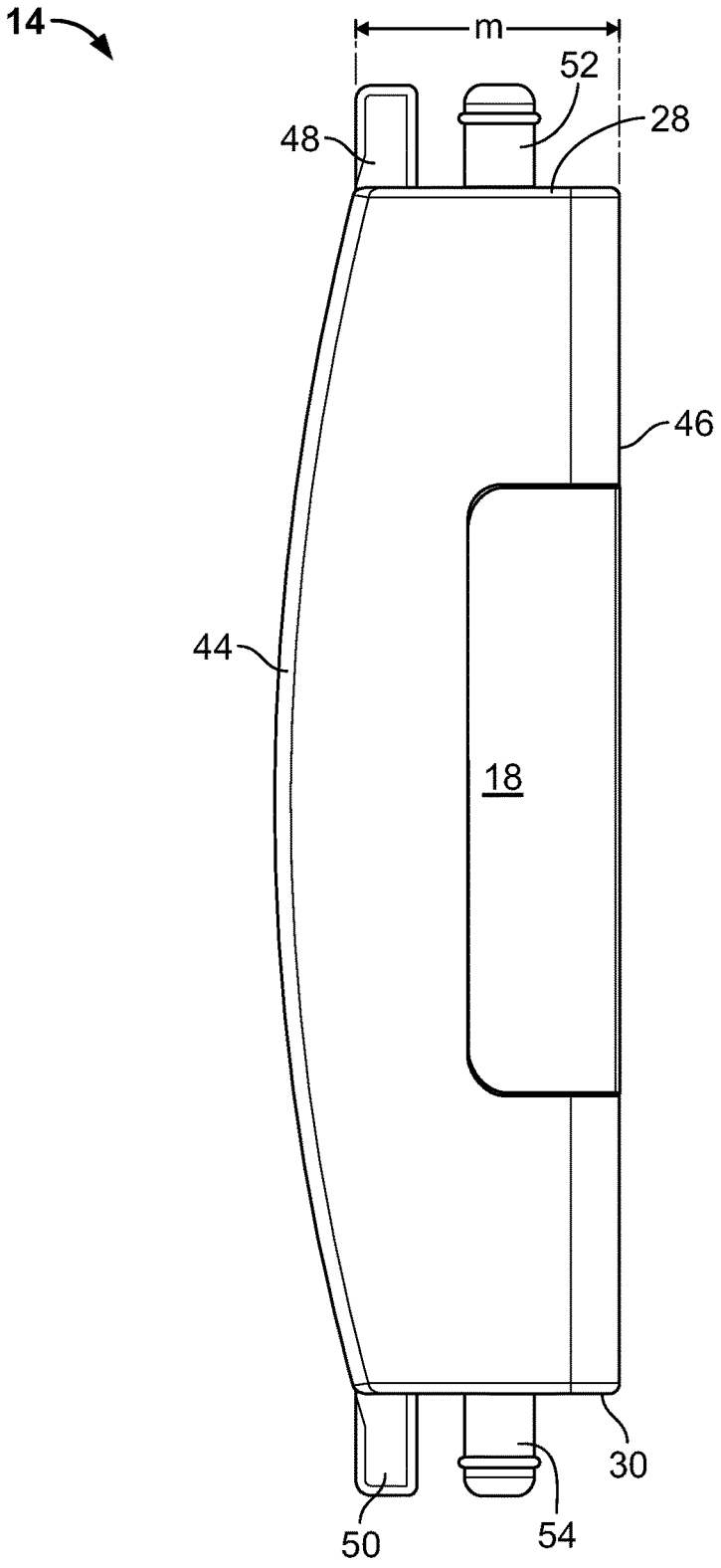
FIG. 4 is a top plan view of one of the connector struts depicted in FIGS. 1 and 2.

FIGS. 3 and 4 provide detailed views of a square-shaped frame 12 and a connector strut 14, respectively, each constructed in the same manner as the frames 12*a*, 12*b* and the connector struts 14*a*-14*d* shown in FIGS. 1 and 2. Referring to FIG. 3, the side segments 16*a*, 16*b*, 16*c*, 16*d* of the frame 12 each include an inner edge (see inner edges 32*a*, 32*b*, 32*c*, and 32*d*), an outer edge (see outer edges 34*a*, 34*b*, 34*c*, 34*d*), and a thickness h defined by the distance between a side segment's outer edge and its corresponding inner edge (e.g., the distance between inner edge 32*a* and outer edge 34*a* of side segment 16*a*). As discussed above, each of the side segments 16*a*-16*d* also houses a respective one of the magnet enclosures 18 proximate to its outer edge (i.e., outer edges 34*a*-34*d*). In one embodiment, each of the inner edges 32*a*-32*d* has a curved shape which provides structural support and a resistance to twisting to each of the side segments 16*a*-16*d*.

Still referring to FIG. 3, the attachment points 26*a*, 26*b*, 26*c*, 26*d* of the frame 12 are integrally connected to their respective adjacent side segments (i.e., attachment point 26*a* is integrally connected to side segments 16*a* and 16*d*, attachment point 26*b* is integrally connected to side segments 16*b* and 16*a*, attachment point 26*c* is integrally connected to side segments 16*c* and 16*b*, and attachment point 26*d* is integrally connected to side segments 16*d* and 16*c*). The attachment points 26*a*-26*d* include corresponding apertures 36*a*, 36*b*, 36*c*, 36*d* and notches 38*a*, 38*b*, 38*c*, 38*d* which extend through the frame 12 depth-wise and serve as the interface through which a respective one of the connector struts 14*a*, 14*b*, 14*c*, 14*d* connects to the frame 12. The apertures 36*a*-36*d* and notches 38*a*-38*d* are sized and shaped to interface with either the first or second attachment ends of the connector struts 14*a*, 14*b*, 14*c*, 14*d* (e.g., first attachment end 28*a* or second attachment end 30*a*) in a manner discussed in further detail below.

Each of the apertures 36*a*-36*d* in the attachment points 26*a*-26*d* is located proximate to a corresponding one of the notches 38*a*-38*d*, and the apertures 36*a*-36*d* and their corresponding notches 38*a*-38*d* define medians 40*a*, 40*b*, 40*c*, and 40*d* in the frame 12. Each of the medians 40*a*-40*d* extends between two adjacent side segments in the frame 12 (i.e., median 40*a* extends between side segments 16*a* and 16*d*; median 40*b* extends between side segments 16*b* and 16*a*; median 40*c* extends between side segments 16*c* and 16*b*; and median 40*d* extends between side segments 16*d* and 16*c*). Each of the medians 40*a*-40*d* has a thickness j (see FIG. 3) defined by the distance between each aperture and its corresponding notch (e.g., the distance between aperture 36*a* and notch 38*a* of attachment point 26*a*).

The attachment points 26*a*-26*d* also include outer border (i.e., perimeter) strips 42*a*, 42*b*, 42*c*, 42*d* in the frame 12 (i.e., outer border strip 42*a* is defined by aperture 36*a* and the curved intersection of outer edges 34*a* and 34*d*; outer border strip 42*b* is defined by aperture 36*b* and the curved intersection of outer edges 34*b* and 34*a*; outer border strip 42*c* is defined by aperture 36*c* and the curved intersection of outer edges 34*c* and 34*b*; and outer border strip 42*d* is defined by aperture 36*d* and the curved intersection of outer edges 34*d* and 34*c*). Each of the outer border strips 42*a*-42*d* has a thickness k (see FIG. 3). The combined dimensions of j and k is less than the thickness h (see FIG. 3) of any of the side segments 16*a*-16*d*. This makes the medians 40*a*-40*d* and the outer border strips 42*a*-42*d* frangible in comparison to the side segments 16*a*-16*d* for reasons discussed further below.

In the embodiment shown in FIG. 3, each of the apertures 36*a*-36*d* is enclosed laterally by its corresponding median, outer border strip, and adjacent side segments (e.g., aperture 36*a* is enclosed by median 40*a*, outer border strip 42*a*, and side segments 16*a* and 16*d*) and has a cylindrical shape. By contrast, each of the notches 38*a*-38*d* has a square or rectangular shape on one side and an open end facing the inside of the frame 12 to facilitate interfacing with a connector strut 14, which will be discussed further detail below. Alternatively, in other embodiments, the apertures 36*a*-36*d* can have a polygonal shape, such as that of a hexagon or an octagon, while the notches 38*a*-38*d* can have a rounded, semicircular shape. Further, in yet another embodiment, the notches 38*a*-38*d* can be replaced with apertures that are enclosed in the frame 12 in a fashion similar to how the apertures 36*a*-36*d* are enclosed by the frame 12.

Turning now to FIG. 4, the connector strut 14 has an inner edge 44, an outer edge 46, and a depth m defined by the distance between the inner edge 44 and the outer edge 46 of the connector strut 14. As discussed above, the connector strut 14 also houses a magnet enclosure 18 proximate to the outer edge 46. In one embodiment, the inner edge 44 has a curved shape, thereby giving the connector strut 14 a curved shape that provides structural support and a resistance to twisting.

As discussed above, the connector strut 14 includes a first attachment end 28 located at one end of the connector strut 14, and a second attachment end 30 located at the opposing end of the connector strut 14. Each of the first and second attachment ends 28, 30 includes an inner post (see inner posts 48 and 50) extending from the attachment end (i.e., first and second attachment ends 28 and 30, respectively) and located proximate to the inner edge 44 of the connector strut 14, and an outer post (see outer posts 52 and 54) extending from the attachment end (i.e., first and second attachment ends 28 and 30, respectively) and located proximate to the outer edge 46 of the connector strut 14. Each of the inner posts 48, 50 is sized and shaped to interface (i.e., interconnect) with any one of the notches 38*a*-38*d* in the frame 12, while each of the outer posts 52, 54 is sized and shaped to interface (i.e., interconnect) with any one of the apertures 36*a*-36*d* in the frame 12. In one embodiment, the inner posts 48, 50 have a rectangular prism shape and the outer posts 52, 54 have a cylindrical shape. In other embodiments, the inner posts 48, 50 have a rounded or semicircular shape while the outer posts 52, 54 have a polygonal prism shape, such as that of a hexagonal or octagonal prism.

Referring back to FIG. 2, the manner in which the connector struts 14*a*-14*d* are connected to the frames 12*a* and 12*b* will now be discussed. By way of example, connector strut 14*a* is positioned in relation to the attachment point 26*a* of frame 12*a* such that the outer post 52*a* and the inner post 48*a* of the connector strut 14*a* are axially aligned with the aperture 36*a* and the notch 38*a*, respectively, of the attachment point 26*a*. The connector strut 14*a* is then brought to and fitted against the attachment point 26*a* of the frame 12*a* so that the inner post 48*a* of the connector strut 14*a* interfaces with the notch 38*a* of the attachment point 26*a* and the outer post 52*a* of the connector strut 14*a* interfaces with the aperture 36*a* of the attachment point 26*a*. The connector strut 14*a* is then held in place by a friction fit between the outer border strip 42*a* and the outer post 52*a*, between the outer post 52*a* and the median 40*a*, and between the median 40*a* and the inner post 48*a*. This arrangement ensures that the outside edge 46*a* of the connector strut 14*a* is facing outwardly relative to the frame 12*a* and is substantially aligned with the outer surface of the outer border strip 42*a* of the frame 12*a*. This positioning enables the magnet enclosure 18 embedded in the connector strut 14*a* to make contact with other similarly situated magnet enclosures of other module assemblies.

The connector strut 14*a* can be removed from the attachment point 26*a* of the frame 12*a* by pulling the connector strut 14*a* away from the frame 12*a*, thereby releasing the inner post 48*a* and outer post 52*a* from the notch 38*a* and the aperture 36*a*, respectively. In one embodiment, the open end of the notch 38*a* facilitates such removal by allowing the connector strut 14*a* to tilt or rotate back and forth about the median 40*a* of the attachment point 26*a* as the connector strut 14*a* is being pulled away from the frame 12*a*, thereby steadily releasing frictional contact between the inner post 48*a* and the outer post 52*a* on one side, and the median 40*a* and the outer border strip 42*a* on the other. This also enables the connector strut 14*a* to more easily release from the attachment point 26*a* of the frame 12*a* when experiencing sheering stress.

Figure 5:
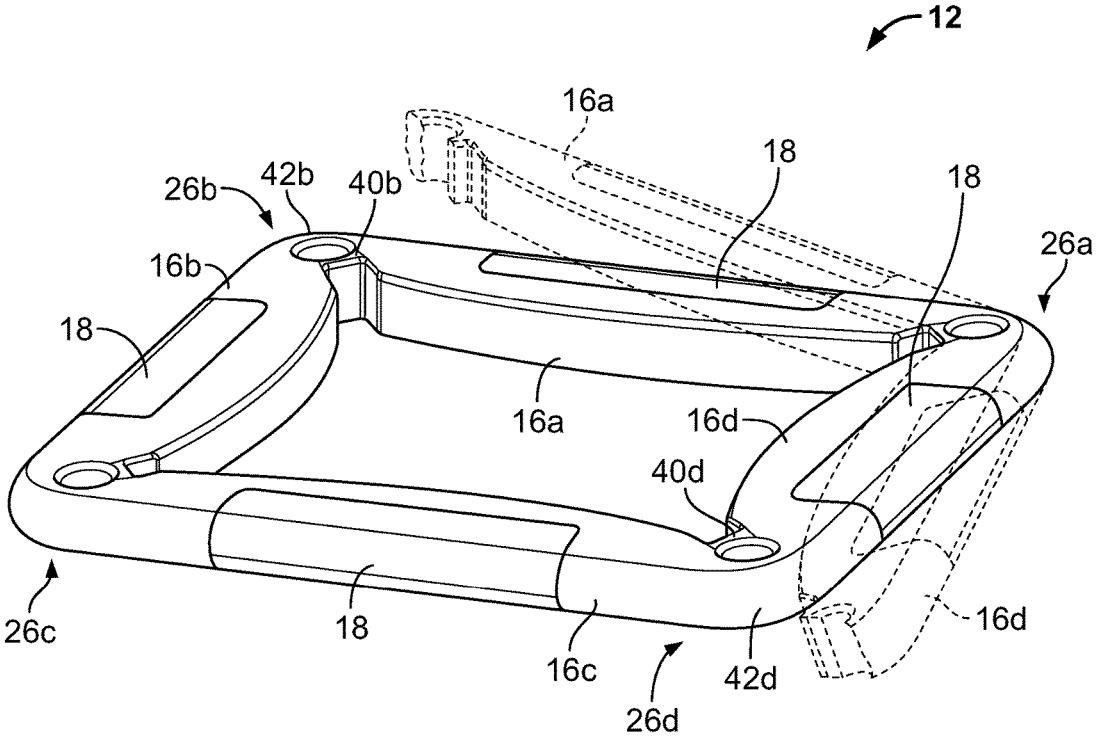
FIG. 5 is a perspective view of the square-shaped frame shown in FIG. 3, with potential deformations of two sides of the square-shaped frame shown in broken lines.

Referring to FIG. 5, this disclosure will now discuss what happens when a frame 12 constructed in accordance with the embodiments discussed above experiences sheering or rotational stress, such as when a user twists the frame 12. As discussed above, the medians 40*a*-40*d* and outer border strips 42*a*-42*d* of the attachment points 26*a*-26*d* are frangible in comparison to the side segments 16*a*-16*d* of the frame 12. Therefore, when the frame 12 is twisted such that two adjacent side segments (e.g., side segments 16*c* and 16*d*) are forced away from each other in a transverse direction, the resulting sheering stress causes the median and the outer border strip of the attachment point between the two side segments in question (e.g., median 40*d* and outer border strip 42*d* of attachment point 26*d*) to break. This break displaces the side segment 16*d* of the frame 12 as shown in phantom. FIG. 5 also shows a similar break occurring at attachment point 26*b*, wherein the median 40*b* and outer border strip 42*b* break, thereby displacing side segment 16*a* as shown in phantom. By breaking at the frangible medians 40*b*, 40*d* and outer border strips 42*b*, 42*d*, the frame 12 maintains the integrity of the adjacent side segments (i.e., side segments 16*a* and 16*b* adjacent to median 40*b* and outer border strip 42*b* and side segments 16*c* and 16*d* adjacent to median 40*d* and outer border strip 42*d*) as well as the respective magnet enclosures 18 of each of the side segments 16*a*-16*d*, thereby preventing the magnets 22 housed therein (not shown in FIG. 5) from escaping.

Figure 6:
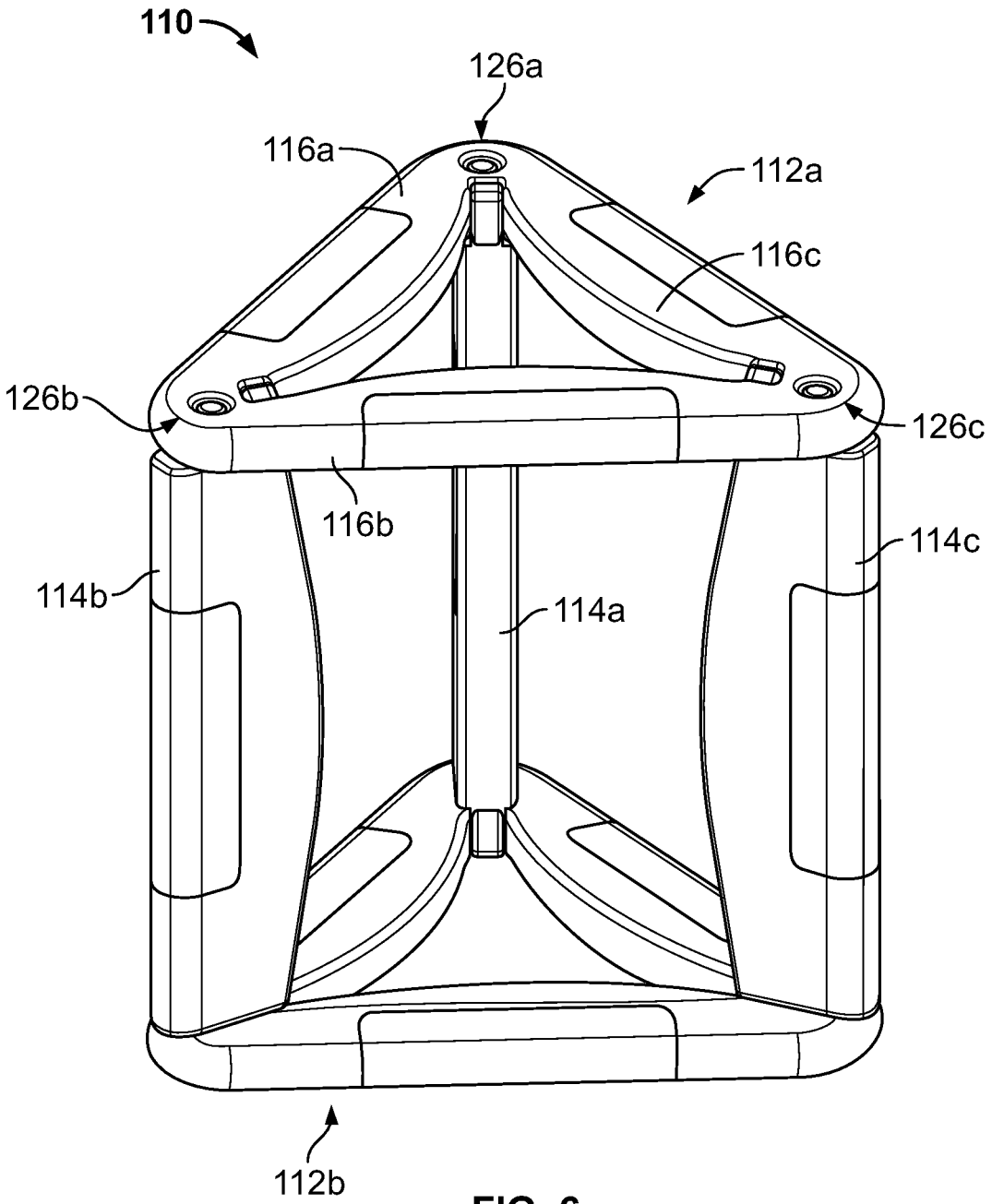
FIG. 6 is a perspective view of a three-dimensional magnetic module assembly constructed in accordance with another embodiment of the present invention, the assembly having two opposing triangle-shaped frames and three connector struts which interconnect with the triangle-shaped frames.

Many variants of the cubic block assembly 10 can be made without departing from the scope of the present invention. For example, FIG. 6 illustrates a three-dimensional triangular prism assembly 110 constructed in accordance with another embodiment of the present invention. The triangular assembly 110 is constructed in a manner similar to that of the cubic assembly 10, with the exception that frames 112*a*, 112*b* have a triangular shape instead of a square shape. As a result, the triangular frames 112*a*, 112*b* include only three side segments 116*a*-116*c* and three attachment points 126*a*-126*c*, and the assembly 110 uses only three connector struts 114*a*-114*c* to interconnect the triangular frames 112*a* and 112*b*. The side segments 116*a*-116*c* and attachment points 126*a*-126*c* are constructed similarly to their counterparts in the square-shaped frame 12 shown in FIG. 3, and the connector struts 114*a*-114*c* are constructed similarly to the connector strut 14 shown in FIG. 4.

Figure 7:
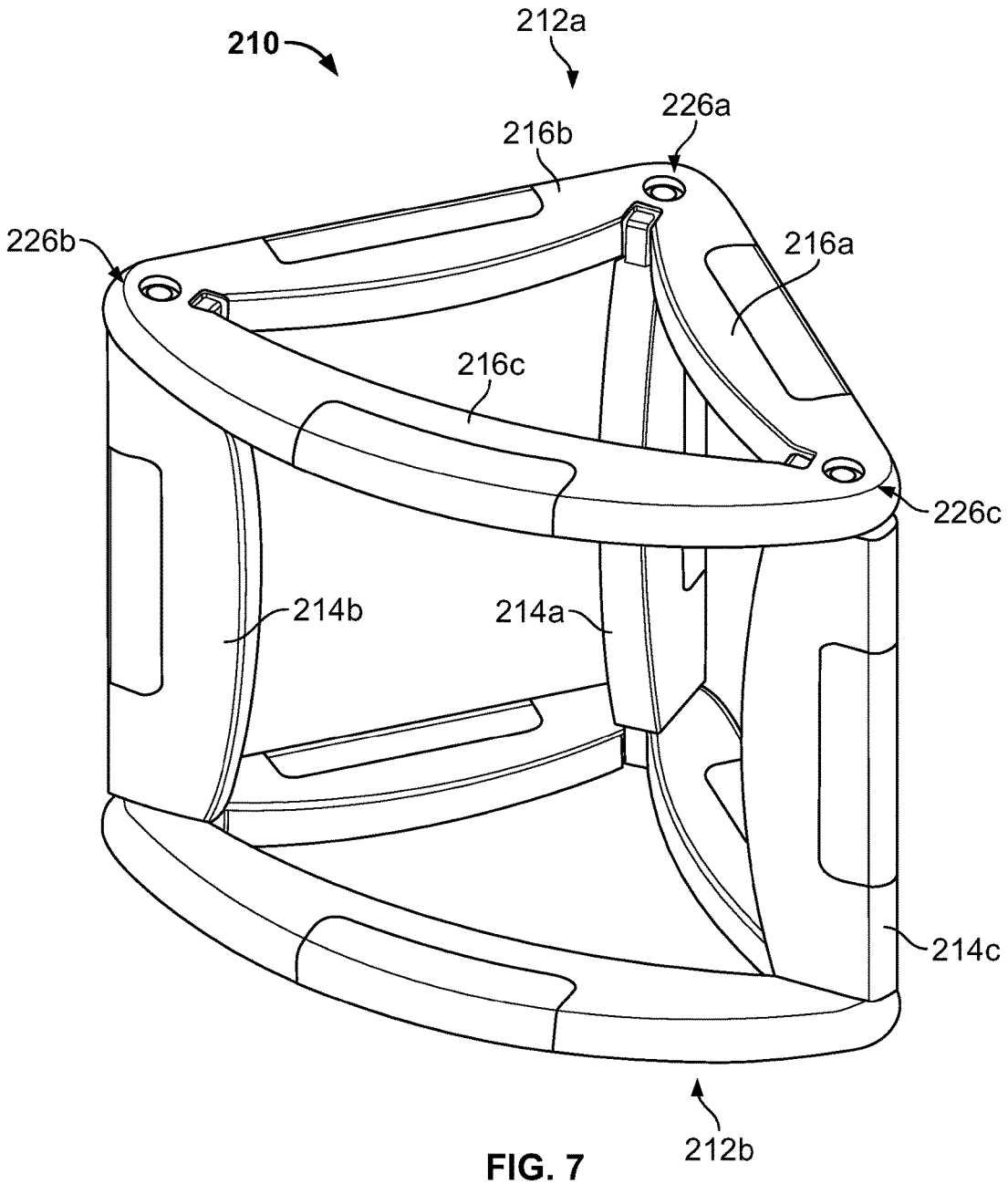
FIG. 7 is a perspective view of a three-dimensional magnetic module assembly constructed in accordance with another embodiment of the present invention, the assembly having two opposing semi-circular (i.e., 90°) frames and three connector struts which interconnect with the semi-circular frames.

FIG. 7 illustrates another three-dimensional prism assembly 210, this time having a semi-circular shape (i.e., a 90° wedge shape). As with the triangular assembly 110 shown in FIG. 6, the wedge assembly 210 is constructed in a manner similar to that of the cubic assembly 10, with the exception that wedge-shaped frames 212*a*, 212*b* have a semi-circular wedge shape instead of a square shape. As a result, the wedge-shaped frames 212*a*, 212*b* include only three side segments 216*a*-216*c* and three attachment points 226*a*-226*c*, and the assembly 210 uses only three connector struts 214*a*-214*c* to interconnect the wedge-shaped frames 212*a* and 212*b*. The side segments 216*a*, 216*b* which form the straight edges of the wedge-shaped frame 212*a* are constructed similarly to the side segments 16*a*-16*d* of the square-shaped frame 12 shown in FIG. 3, but the third side segment 216*c* has an arcuate shape to create the desired wedge shape. As with the triangular prism assembly 110 shown in FIG. 6, the connector struts 214*a*-214*c* of the wedge-shaped prism assembly 210 are constructed similarly to the connector strut 14 shown in FIG. 4.

Figure 8:
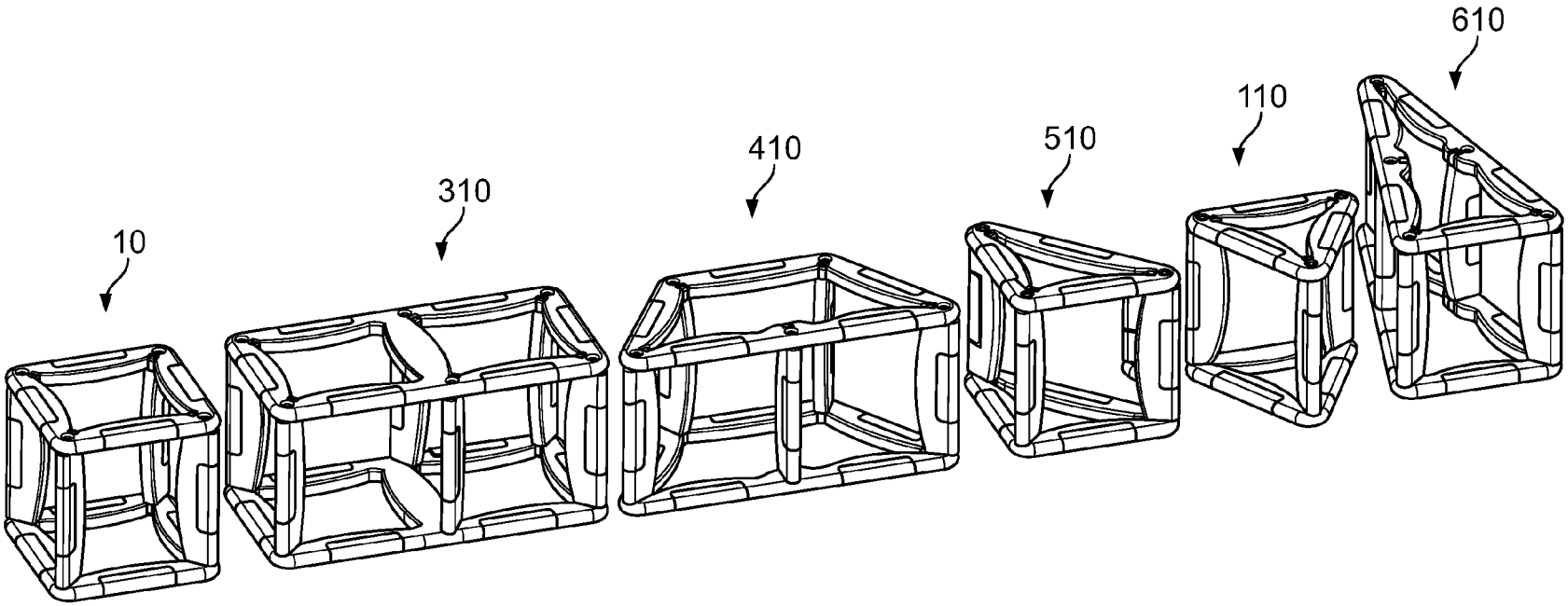
FIG. 8 is a perspective view of a plurality of three-dimensional magnetic module assemblies constructed in accordance with other embodiments of the present invention.

Other embodiments of the present invention include other prism shapes such as those shown in FIG. 8. These embodiments include, but are not limited to, a rectangular prism 310, a trapezoidal prism 410, a right triangular prism 510, an isosceles triangular prism 610, a pentagonal prism (not shown), and a hexagonal prism (not shown).

Figure 9:
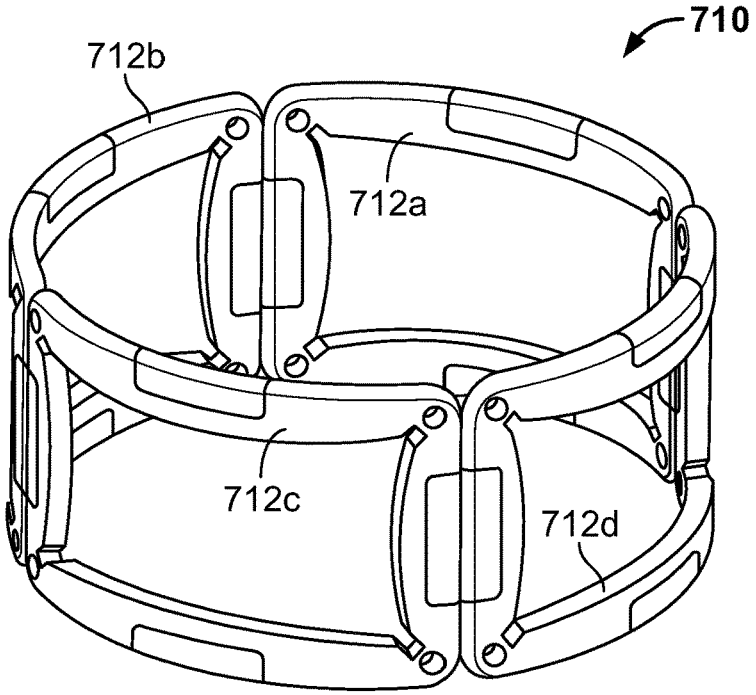
FIG. 9 is a perspective view of a three dimensional magnetic module assembly constructed in accordance with another embodiment of the present invention, the assembly having four arcuate frames which are interconnected (i.e., in end-to-end fashion) to give the assembly a cylindrical shape.
Figure 10:
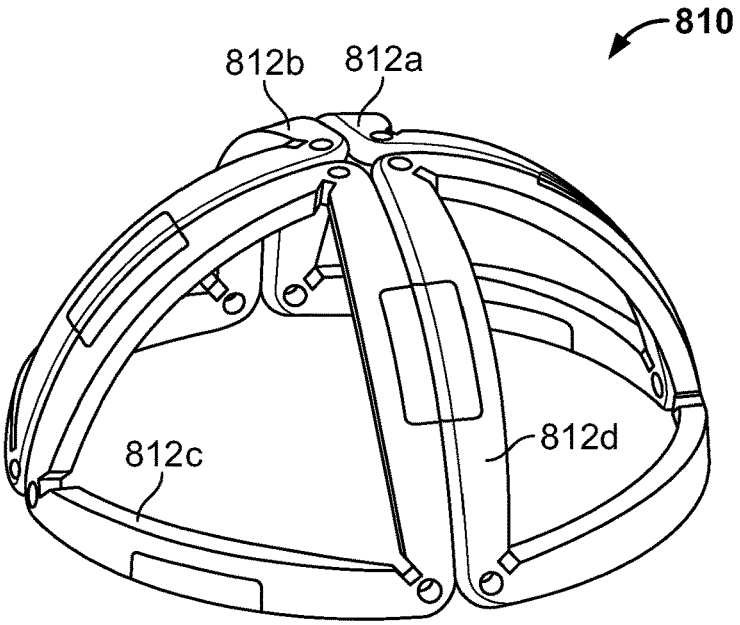
FIG. 10 is a perspective view of a three dimensional magnetic module assembly constructed in accordance with another embodiment of the present invention, the assembly having four triangular frames which are curved and interconnected (i.e., in side-by-side fashion) to give the assembly a hemispherical shape.

Further embodiments include assemblies with frames which are curved to create three-dimensional geometric shapes with arcuate surfaces. For example, FIG. 9 illustrates a cylindrical assembly 710 constructed from four rectangular frames 712*a*, 712*b*, 712*c*, 712*d* which are curved along their longest sides by ninety degrees, thereby giving each frame an arcuate shape. When assembled, the four frames 712*a*-712*d* form the shape of a cylinder. As another example, FIG. 10 illustrates a hemispherical assembly 810 constructed from four triangular frames 812*a*, 812*b*, 812*c*, 812*d* which are curved such that when assembled, they form the shape of a hemisphere. All such shapes are included within the scope of the present disclosure.

All examples and conditional language recited herein are intended for pedagogical purposes to aid the reader in understanding the principles of the invention and the concepts contributed by the inventor to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

It will be understood that the embodiments described herein are merely exemplary and that a person skilled in the art may make many variations and modifications without departing from the spirit and scope of the invention. All such variations and modifications are intended to be included within the scope of the invention as described in the appended claims.

We claim:

1. A module for a toy construction kit, said module comprising a rigid frame having at least three legs, each of said legs having a first end and a second end opposite said first end, said legs defining a closed geometric figure which lies in a plane defined by said frame and which includes an open interior and at least three corners, each of said corners having receiving means for receiving at least a pair of posts of a different, but connectable, module, each of said receiving means including an aperture and a notch proximate said aperture and open to said interior of said frame, wherein at least one of said legs of said frame has a first longitudinal axis, an edge opposite said interior of said frame, a cavity at said edge for receiving a bar magnet having a second longitudinal axis, said magnet being oriented in said cavity such that said second longitudinal axis is substantially parallel to said first longitudinal axis, and a cap covering said magnet and said cavity, and wherein said aperture and said notch of each of said receiving means cooperate to render said corners of said frame frangible such that applying shearing or rotational stress to said frame causes at least one of said corners to relieve such stress by breaking in the vicinity of its said aperture and its said notch, whereby the integrity of each of said legs is maintained between said first and second ends thereof to thereby inhibit the inadvertent removal of said magnet from said cavity.

2. The module of claim 1, wherein said cap includes gripping means for gripping said at least one of said legs such that said cap is attached thereto with a snap fit.

3. The module of claim 1, wherein said magnet is oriented in said cavity between a pair of nubs, one of which extends longitudinally from one end of said cavity and the other of which extends longitudinally from an opposite end of said cavity.

4. The module of claim 1, wherein said cap is welded to said at least one of said legs.

5. The module of claim 1, wherein each of said legs has a first edge opposite said interior of said frame that is a straight edge and a second edge facing said interior of said frame that is a curved edge having a convex shape relative to its respective straight edge.

6. The module of claim 1, wherein each of said legs is thicker between said first and second ends thereof than at said first and second ends thereof.

7. A toy construction kit, comprising a plurality of rigid frames, each frame having at least three legs, each of said legs having a first end and a second end opposite said first end, said legs defining a closed geometric figure which lies in a plane defined by said frame and which includes an open interior and at least three corners, each of said corners having receiving means for receiving at least a pair of posts, each of said receiving means including an aperture and a notch proximate said aperture and open to said interior of said frame, wherein at least one of said legs of said frame has a first longitudinal axis, an edge opposite said interior of said frame, a cavity at said edge for receiving a bar magnet having a second longitudinal axis, said magnet being oriented in said cavity such that said second longitudinal axis is substantially parallel to said first longitudinal axis, and a cap covering said magnet and said cavity, and wherein said aperture and said notch of each of said receiving means cooperate to render said corners of said frame frangible such that applying shearing or rotational stress to said frame causes at least one of said corners to relieve such stress by breaking in the vicinity of its said aperture and its said notch, whereby the integrity of each of said legs is maintained between said first and second ends thereof to thereby inhibit the inadvertent removal of said magnet from said cavity; and a plurality of connector struts, each connector strut having a first end and a second end opposite said first end, and a third longitudinal axis extending through said first and second ends, said first end having first and second posts projecting from said first end in a first direction parallel to said third longitudinal axis, and said second end having third and fourth posts extending from said second end in a second direction parallel to said third longitudinal axis, said first and second posts being sized and shaped to be receivable in said receiving means of a first one of said frames and said third and fourth posts being sized and shaped to be receivable in said receiving means of a second one of said frames.

8. The toy construction kit of claim 7, wherein said plurality of frames includes at least one frame having the shape of a segment of a sphere.

9. The toy construction kit of claim 7, wherein said plurality of frames includes at least one frame having the shape of a segment of a cylinder.

10. The toy construction kit of claim 7, wherein said struts are mechanically attachable to said frames through interaction of said first and second posts with said apertures and said notches of said receiving means.

11. The toy construction kit of claim 7, wherein said struts further include magnets so that said frames and said struts are magnetically and interchangeably connectable.

* * * * *